US008763164B2

(12) United States Patent
MacGillivray

(10) Patent No.: US 8,763,164 B2
(45) Date of Patent: Jul. 1, 2014

(54) CONVERTIBLE MATERNITY GARMENT

(76) Inventor: Kathy MacGillivray, Bedford (CA)

( * ) Notice: Subject to any disclaimer, the term of this patent is extended or adjusted under 35 U.S.C. 154(b) by 671 days.

(21) Appl. No.: 12/459,965

(22) Filed: Jul. 10, 2009

(65) Prior Publication Data

US 2011/0004976 A1 Jan. 13, 2011

(51) Int. Cl.
*A41D 1/14* (2006.01)

(52) U.S. Cl.
USPC ..... 2/221

(58) Field of Classification Search
CPC ... A41D 1/062; A41D 2300/322; A41D 1/06; A41D 1/20; A41F 9/00; A41F 9/02
USPC ..... 2/221, 311, 76, 232, 338, 237
See application file for complete search history.

(56) References Cited

U.S. PATENT DOCUMENTS 4,139,913 A * 2/1979 Garin et al. ..... 2/237
4,280,229 A * 7/1981 Stein ..... 2/221
4,580,298 A * 4/1986 Tuisl ..... 2/237
4,912,860 A * 4/1990 Keller ..... 36/4
5,050,244 A 9/1991 Kleinman
5,163,184 A 11/1992 Reardon
6,081,930 A * 7/2000 Phillips ..... 2/237
6,085,356 A * 7/2000 Redmond, Sr. ..... 2/237
6,922,849 B1 * 8/2005 Fedrick ..... 2/227
7,124,448 B2 * 10/2006 Davenport ..... 2/229
7,181,775 B2 * 2/2007 Carney ..... 2/311
2004/0049834 A1 * 3/2004 Stangle et al. ..... 2/338
2004/0163159 A1 * 8/2004 Edwards et al. ..... 2/338
2005/0268379 A1 * 12/2005 MacGeorge ..... 2/400
2006/0010571 A1 * 1/2006 Oakley ..... 2/227
2006/0218690 A1 * 10/2006 James ..... 2/69
2008/0172769 A1 * 7/2008 Herget ..... 2/76
2008/0295225 A1 * 12/2008 Hendrickson et al. ..... 2/237
2010/0235965 A1 * 9/2010 Frandsen et al. ..... 2/237

FOREIGN PATENT DOCUMENTS

GB 191108741 A 0/1911
WO WO 2009/026187 A1 2/2009

* cited by examiner

*Primary Examiner* — Khoa Huynh
*Assistant Examiner* — Anna Kinsaul
(74) *Attorney, Agent, or Firm* — Frank J. Bonini, Jr.; John F. A. Earley, III; Harding, Earley, Follmer & Frailey, P.C.

(57) ABSTRACT

A convertible maternity garment that includes a first garment configured and arranged as a maternity garment to be worn by a woman during her maternity term and a second garment constructed from a portion of the first garment to provide a garment having a configuration for non-maternity use, where a removable portion is provided and where a first waistband and an alternate waistband are provided and configured so that both waistbands are functional waistbands that may be present on the garment simultaneously, but are selectively functional.

20 Claims, 6 Drawing Sheets

CONVERTIBLE MATERNITY GARMENT

BACKGROUND OF THE INVENTION

1. Field of the Invention

The present invention relates to the field of garments, and more particularly convertible maternity garments.

2. Brief Description of the Related Art

Maternity clothing is generally purchased and worn by women during the term of their pregnancies. A number of different garments must be purchased and worn over the maternity term, which generally lasts about nine months. Though a woman may use non-maternity clothing during the initial stages of her pregnancy, as the woman's body changes, namely, as the fetus develops and grows, special clothing to conform to the woman's body is needed. The maternity clothing generally provides comfort for the woman wearing it. As a woman's body changes during the pregnancy term, a woman may need to change sizes of maternity clothing to accommodate her shape. Maternity clothing generally is costly, and, therefore, a woman may be required to purchase a number of wardrobes, in different sizes, over the term of her pregnancy.

In addition to the cost of the clothing that must be purchased to accommodate sizes as the women's shape changes during her pregnancy, the maternity clothing is designed to be suitable for the period of the pregnancy term. Therefore, after the birth of the child, and, in particular, when a women's body returns to a post-maternity shape, the maternity clothing is no longer used. Many women store the maternity clothing for subsequent maternity periods, such as when having another child. However, the maternity clothing is not used by women after their pregnancy since the maternity clothing is generally much larger and is configured differently than the clothing that women require after their pregnancy term.

Once the maternity clothing is no longer needed after the pregnancy term and after the potential post-maternity period (when some maternity clothing still may be usable), women are no longer able to use for the maternity clothing. This practice of purchasing a special maternity wardrobe or garments for limited use, results in increased expenses for pregnant women, since, they must buy multiple wardrobes that include clothing that a woman may only wear for a short duration, such as, for example, a few weeks or months.

A need exists for a maternity garment that provides both comfort and ease of use during both maternity periods and pre or post maternity periods.

SUMMARY OF THE INVENTION

A convertible garment is provided that is configurable to allow a woman to use the garment as a maternity garment during pregnancy and as a non-maternity garment during pre or post pregnancy periods.

According to preferred embodiments, a garment is provided configured, for example, as pants, skirt, or shorts, and includes a removable maternity panel or band that functions for maternity use when the garment is worn by a woman during her pregnancy, and is adaptable for fully functional wear after pregnancy.

According to preferred embodiments, the garment may be constructed to form a first garment which includes a maternity panel portion connected to a bottom portion. The bottom portion may, for example, include bottoms, namely pants, skirt, shorts.

According to a preferred embodiment, the garment may include a removable maternity panel that is attached by a releasable fastening component, such as, for example, stitching on the inside lower portion of a waistband of a bottom, for example pants, skirt and/or shorts. The garment may be configured so that the removable maternity panel may be reinstalled so that the garment may be subsequently used as a maternity garment, even after it has been converted to a non-maternity garment.

The bottom has a fully functional waistband closure and zipper. After the baby is born, the woman removes the maternity panel and has a fully functional bottom to wear as regular bottoms. These initially maternity bottoms are worn with the maternity panel during pregnancy and the maternity panel is removed after the baby is born for regular wear of bottoms.

According to preferred embodiment of the invention, a garment preferably is constructed to provide a comfortable bottom, such as, for example, a skirt, short or pant, to wear during pregnancy, and also to provide a garment that may be worn by a woman long after the baby is born.

BRIEF DESCRIPTION OF THE DRAWING FIGURES

DETAILED DESCRIPTION OF THE PREFERRED EMBODIMENTS

Figure 1:
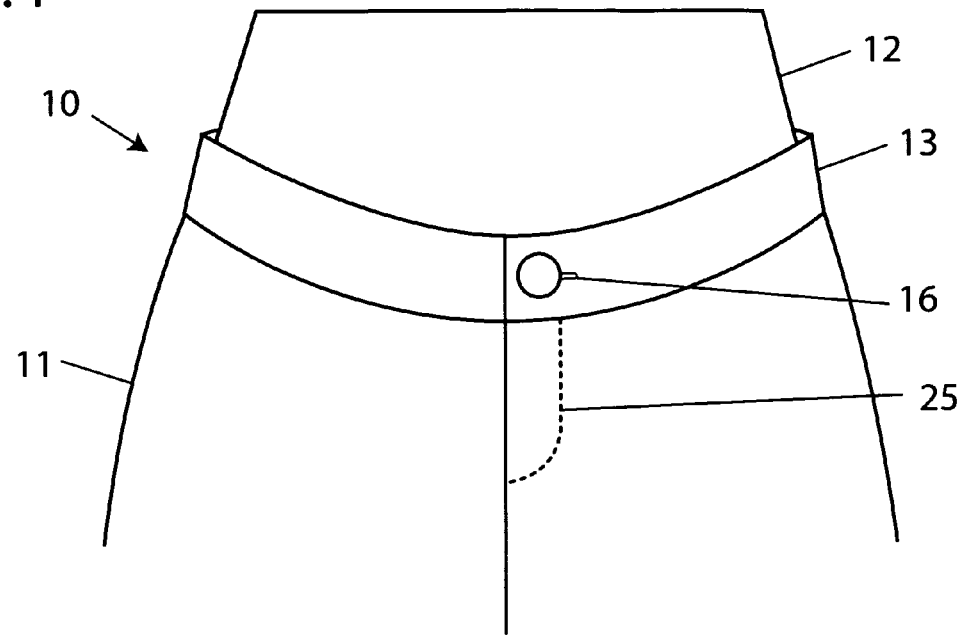
FIG. 1 is front elevation view of a first embodiment of my invention illustrating a garment bottom with an attached maternity panel or band.

Referring to FIG. 1, there is illustrated a preferred embodiment of a convertible maternity garment 10, including a bottom 11 which is configured having a maternity band 12 which is attached to the garment bottom 11. The maternity band 12 is shown attached to the garment bottom 11 and is connected at the interior of the garment 10 as shown by the rear sectional view of FIG. 4 and the top plan view of FIG. 11. The garment bottom 11 preferably is provided having an alternate waistband 13 which is configured and arranged as part of the garment bottom 11. The alternate waistband 13, according to preferred embodiments, comprises a functioning waistband 13 that may be used with a fastening member, such as, for example, the button 15 shown in connection with the button hole 16 through which the button 15, when fastened, may pass. As illustrated, the button hole 16 may be formed on the alternate waistband 13 using suitable button hole making methods, such as, for example, known sewing techniques. The maternity band 12 is shown in FIG. 1 situated behind the zone where the first end 18 and second end 19 of the alternate waistband 13 come together (see FIG. 3).

According to the embodiment illustrated in the drawing figures, a zipper fly 21 is provided and preferably is attached to the garment bottom 11 at the opening edges 22, 23 surrounding the fly opening 24. The zipper fly 21 preferably is attached by suitable stitching methods, such as with the stitching 25, 26 or other suitable alternate attachment means.

Figure 3:
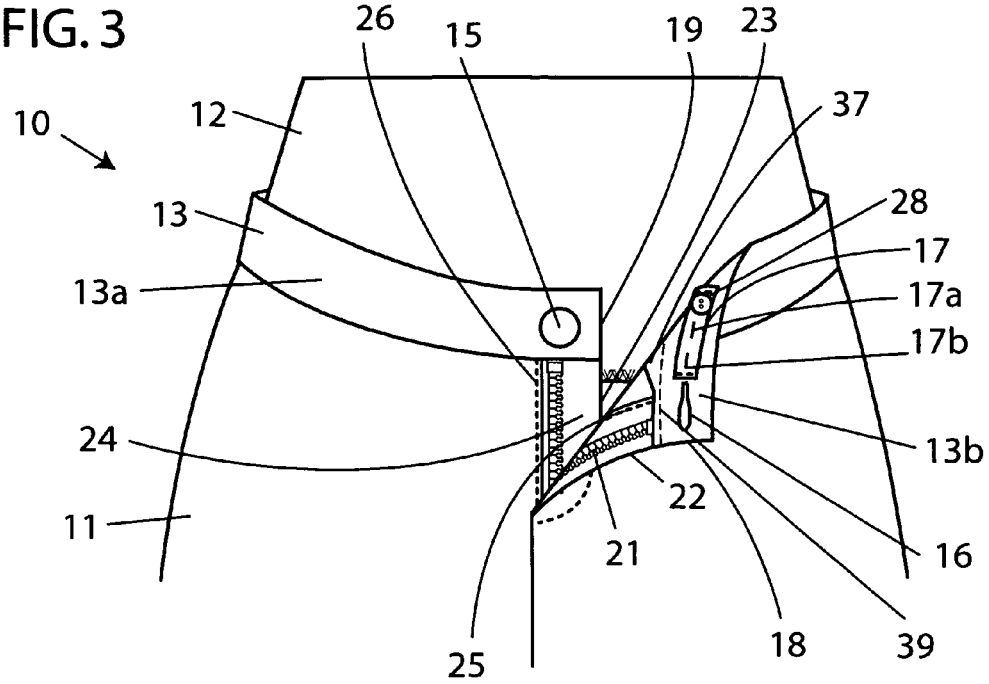
FIG. 3 is a front elevation view of the garment shown in FIG. 1, illustrated showing the opening of the garment.
Figure 8:
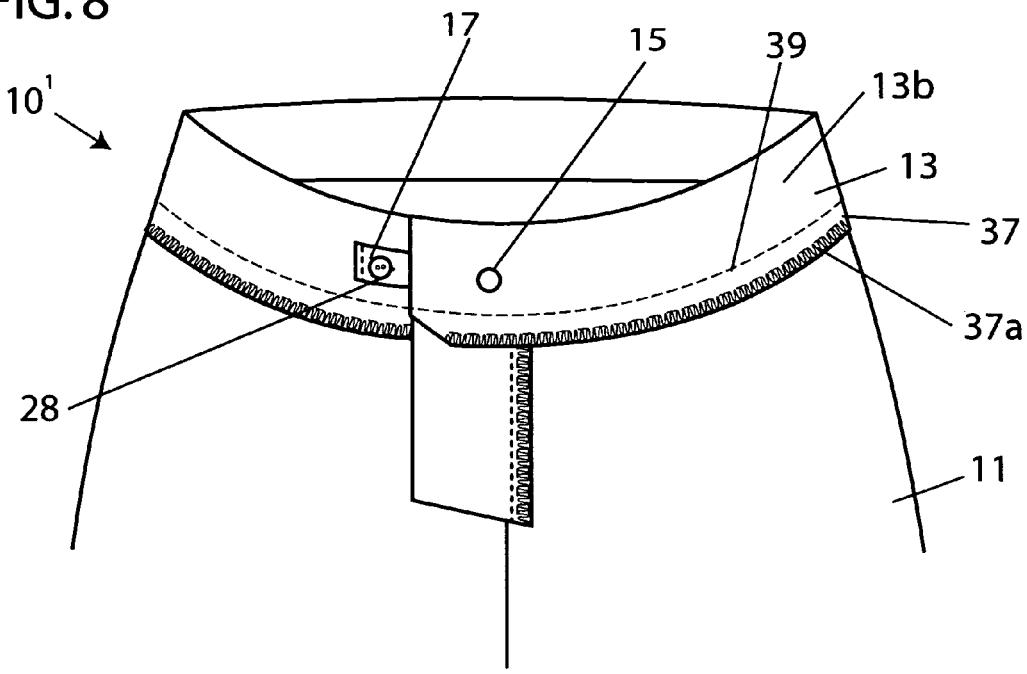
FIG. 8 is a cross-sectional view of the garment shown in FIG. 6, looking at the inside portion of the front of the garment as viewed from the inside of the garment, and being shown with the maternity band detached.
Figure 9:
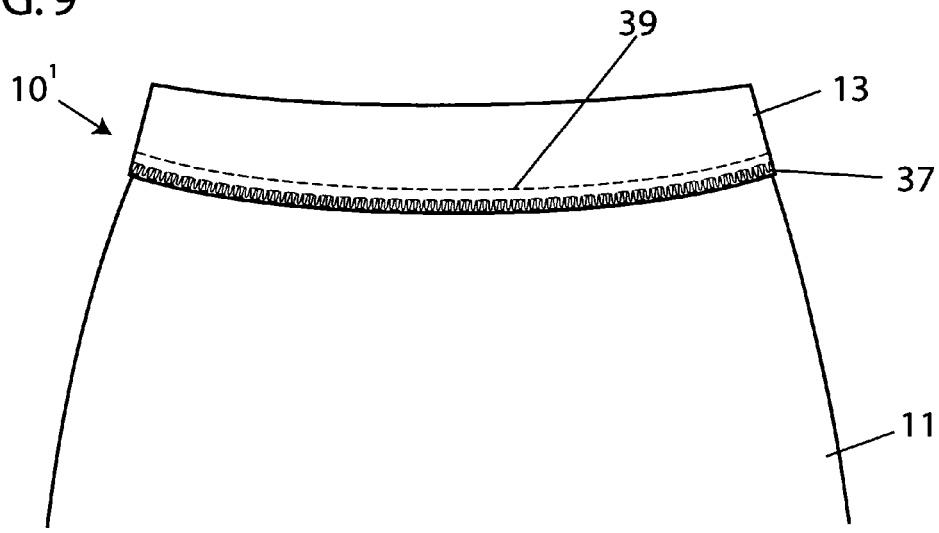
FIG. 9 is a cross-sectional view of the garment shown in FIG. 6, looking at the inside portion of the rear of the garment as viewed from the inside of the garment, and being shown with the maternity band detached.
Figure 10:
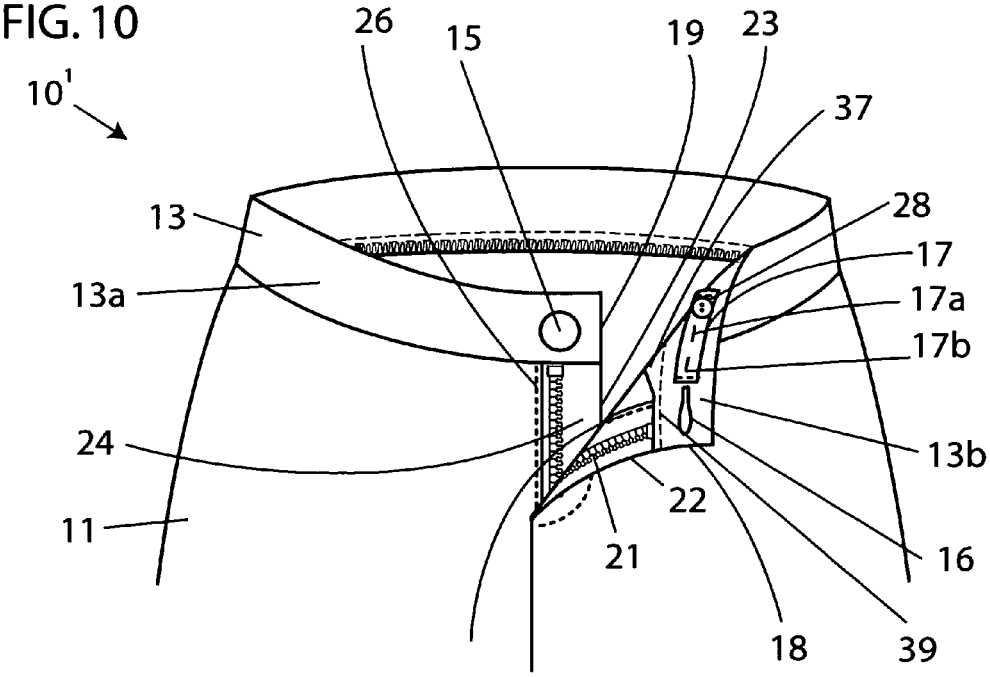
FIG. 10 is an enlarged front view of the garment shown in FIG. 6, illustrated showing the opening of the garment.

According to a preferred embodiment, a secondary fastening component 17 is utilized to provide an adjustable fastening feature that may be used to secure the first end 18 of the alternate waistband 13 to the other side or second end 19 of the waistband 13. The adjustable fastening component 17 preferably may be formed from an elastic member that may be stretched to engage the button 15. As illustrated in FIGS. 3, 8 and 10, the adjustable fastening member 17 preferably has a plurality of alternate button hole positioning options provided by the button holes 17*a*, 17*b*, and is shown held on the alternate waistband 13 with a fastening member, such as, for example, the button 28.

According to a preferred embodiment, the maternity band 12 may be constructed from known commercially available materials, including, for example, materials which are flexible and can give to accommodate the wearer's shape. Preferably, a flexible material that may be firm yet substantially stretchable material, such as, for example, commercially available firmly-knit or elastic may be used to construct the maternity band 12. The maternity band 12 may be constructed from a single layer of fabric, or alternatively, multiple layers of material may be used. When using multiple layers, the layers preferably are situated so that the maternity band 12 is not awkward, but rather, may still be comfortable to wear. Examples of multilayer configurations include bonding of fabric layer, such as, for example, with a fabric adhesive, sewing, or other suitable attachment mechanisms.

Figure 2:
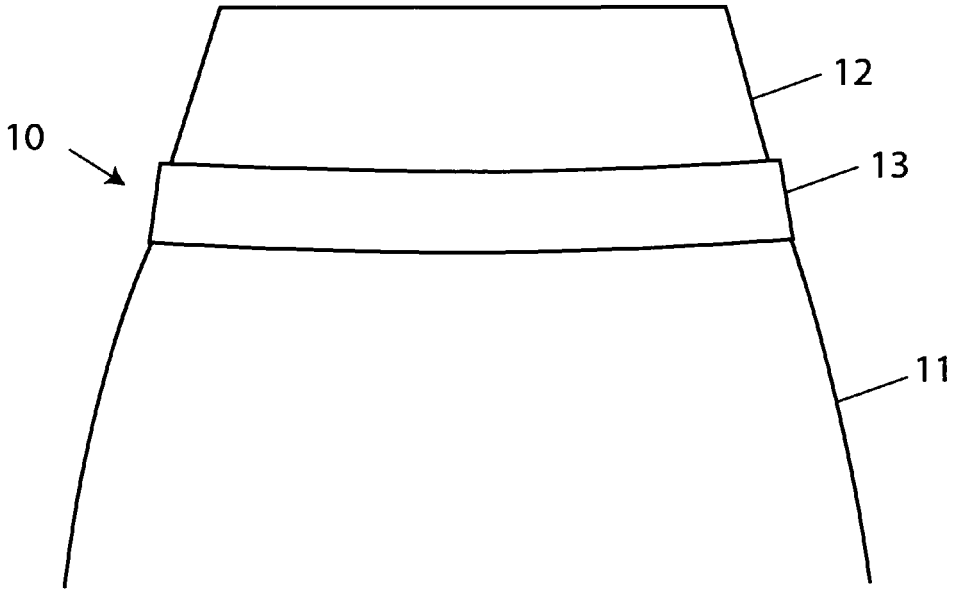
FIG. 2 is a rear elevation view of the garment of FIG. 1.

The rear of the garment 10 is shown in FIG. 2 where the alternate waistband 13 is disposed about the garment 10 and the garment bottom 11 is shown below the alternate waistband 13. The maternity band 12 generally forms an opening 49 at the top of the garment 10 (FIG. 11) that accommodates a wearer's torso, or in other words, the pregnant woman's abdomen or belly. According to preferred embodiments, the maternity band 12 is attached on the interior of the garment 10 and is located behind the alternate waistband 13. Preferably, as best illustrated in FIG. 3, the maternity band 12 is attached at a location along the interior of the garment 10 below the alternate waistband 13. The maternity band 12 is shown having an edge portion 27 at its perimeter which preferably comprises stitching or other edge finish so that the edge remains soft and/or comfortable for the wearer when the garment 10 is worm. The maternity band 12 preferably is removably attached to the garment bottom 11 in the area proximate to the edge portion 27. The maternity band 12 preferably includes an attachment zone where the maternity band 12 attaches to the garment bottom 11. The maternity band 12 is shown being attached on the inside of the garment 10. A releasable securing component is provided to secure the maternity band 12 to the garment bottom 11. According to a preferred embodiment, the releasable securing component is illustrated comprising stitching 30, which secures the maternity band 12 to the waistband of the garment 10. Though illustrated as stitching, the releasable securing component may, for example, comprise alternative fastening elements, such as, for example, zippers, snaps or other suitable members. The stitching 30 (or other fastening component used) preferably is applied in a manner that permits removal thereof without damage to the garment 10 or maternity band 12 so that the maternity band 12 may be reinstalled if desired.

Figure 4:
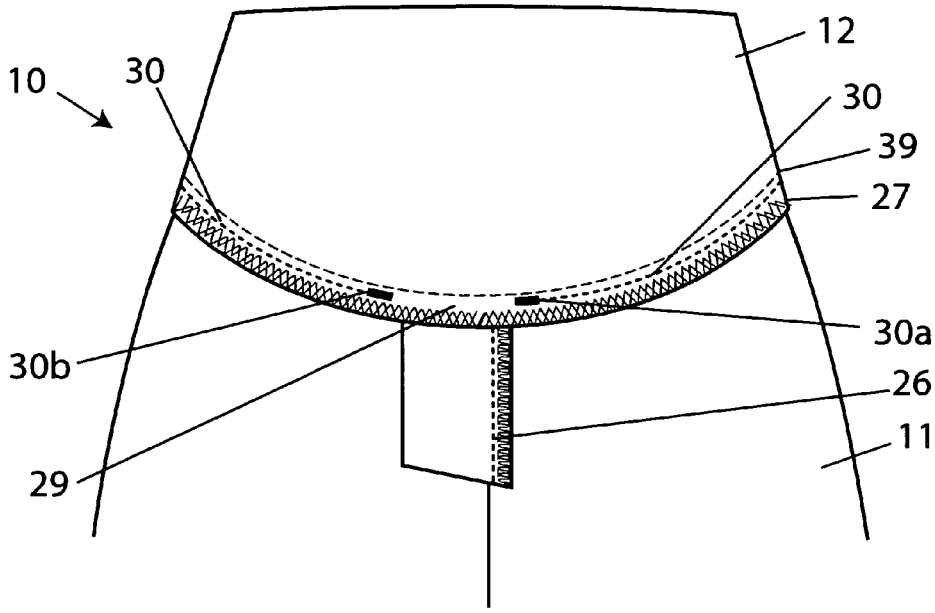
FIG. 4 is a cross-sectional view of the garment shown in FIG. 1, looking at the inside portion of the front of the garment as viewed from the inside of the garment.
Figure 5:
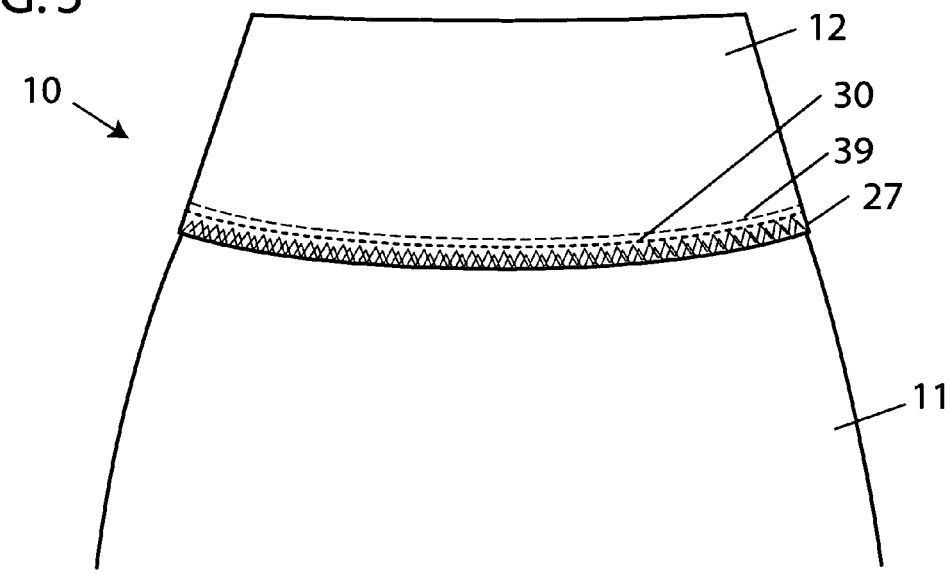
FIG. 5 is a cross-sectional view of the garment shown in FIG. 1, looking at the inside portion of the rear of the garment as viewed from the inside of the garment.
Figure 6:
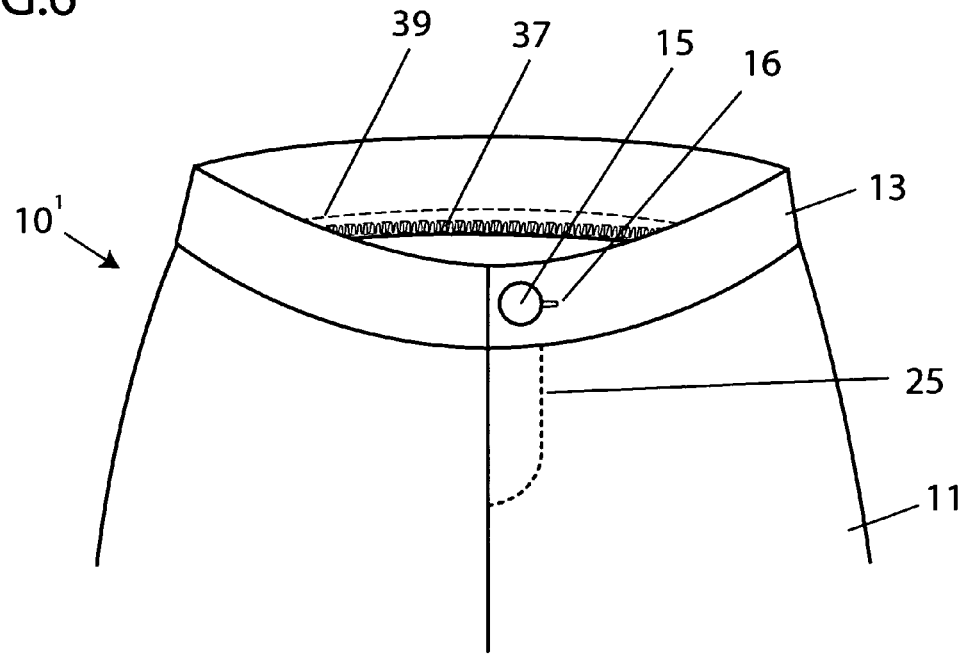
FIG. 6 is a front elevation view of the garment of FIG. 1, shown with the maternity band detached.
Figure 11:
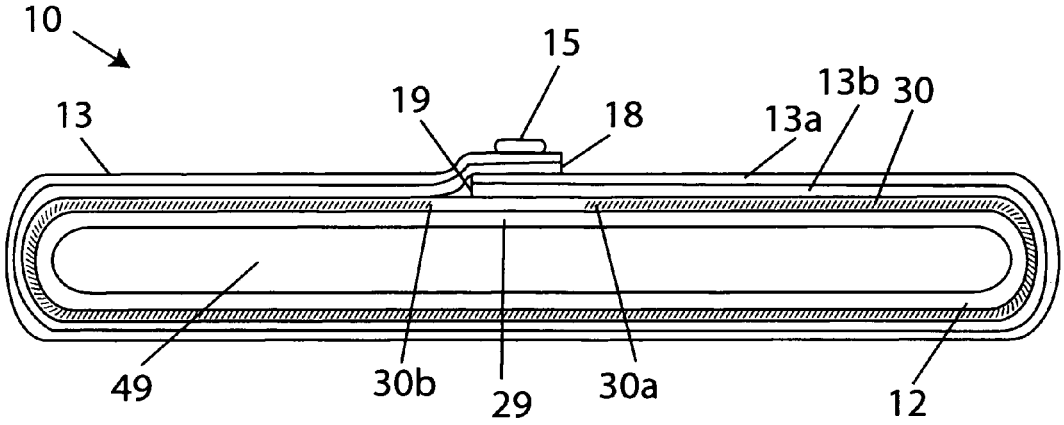
FIG. 11 is a top plan view of the garment of FIG. 1, shown with the maternity band installed on the garment bottom.

The garment 10 preferably is convertible from a maternity garment 10 (see FIGS. 1 through 5 and 11) to a non-maternity garment 10' (see FIGS. 6 though 10). According to a preferred embodiment, the conversion may be carried out by removing the maternity band 12 to convert the alternate waistband 13 to the waistband forming a top of the garment 10'. The non-maternity garment 10' is configured to utilize the alternate waistband 13, which preferably may be formed from two layers and may be secured with stitching 39, as shown in FIGS. 8 and 11. The alternate waistband stitching 39 also is shown in FIG. 4 and underlies the maternity band 12 (but in the embodiment illustrated would not be visible to the user in the view of FIG. 4).

A preferred method for accomplishing the conversion is achieved by releasing or unfastening the stitching 30 shown connecting the maternity band 12 to the garment bottom 11. According to a preferred configuration, as best shown in FIGS. 4 and 11, the stitching 30 may terminate prior to the fly area or fly opening 24, where the stitching 30 has a first terminal end 30*a* and second terminal end 30*b* defining an expansion zone 29 between the terminal ends 30*a*, 30*b* so that the portion of the maternity band 12 proximate to the fly opening 24 may be stretchable as needed by the wearer. For example, when the adjustable fastening component 17 is utilized, the free zone or expansion zone 29 may stretch as needed. The stitching 30 securing the maternity band 12 to the garment 10 preferably is provided in a configuration that permits the maternity band 12 to be open or unattached over the fly opening area 24 of the waistband 13 and bottom 11.

The garment 10 is configured so that the removal of the maternity band 12 provides the converted garment 10' with comfort features. According to a preferred embodiment, the resultant garment 10' (FIG. 6) shows the interior of the garment 10' having a comfort zone which is formed by the alternate waistband 13 which is shown layered with the maternity band 12 in FIG. 11. Preferably, the maternity band 12 is detachable from the garment bottom 11. Referring to FIG. 8, where the garment 10' is shown with the maternity band 12 detached, the edge portion 37 of the alternate waistband 13 is also shown, and, according to a preferred embodiment, has a terminal perimeter portion 37*a* which may comprise a stitched edge.

Figure 7:
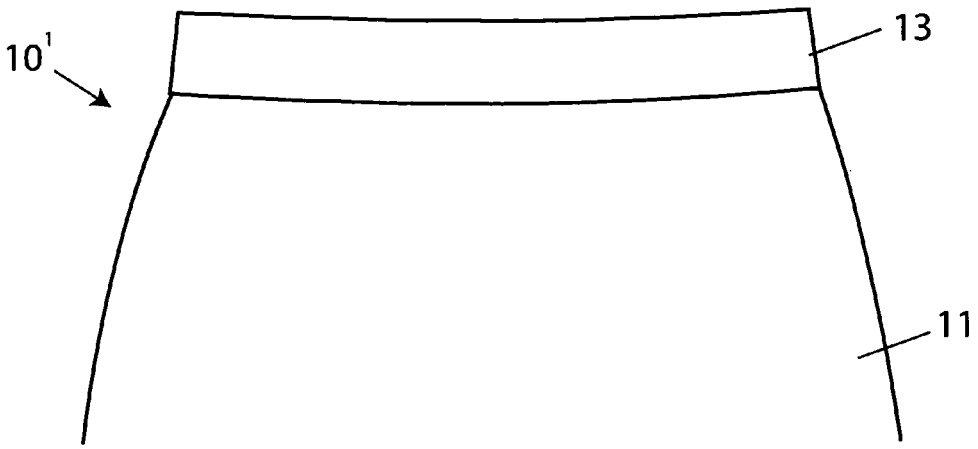
FIG. 7 is a rear elevation view of the garment of FIG. 1 shown with the maternity band detached.

As discussed herein, a preferred connection mechanism that may be used to attach the maternity band 12 to the bottom 11 may comprise stitching 30, which, when it is desired to convert the garment 10 to a non-maternity garment 10', may be broken away or cut to release the upper portion of the maternity band 12 from the garment 10. As illustrated in FIGS. 6 and 7, the garment 10 has been converted to a non-maternity garment 10'. The garment bottom 11 preferably is configured so that it may retain its appearance in both the maternity configuration of the garment 10 and the non-maternity configuration 10'. According to a preferred configuration, as shown in FIG. 11, the alternate waistband 13 of the garment 10 is shown having a multilayer construction, including an interior layer 13*b* and an exterior layer 13*a*. The maternity band 12 is shown attached to the interior layer 13*b* of the alternate waistband 13. Preferably, the waistband 13 is configured with an extra seam allowance to accommodate the attachment of the maternity band 12. The extra seam allowance may be provided on the interior of the alternate waistband 13, and, according to a preferred embodiment, the height of the interior layer 13*b* may be greater than the exterior layer 13*a*. The maternity band 12 preferably is removably connected to the alternate waistband 13 so that the removal of the maternity band 12 may be accomplished in a manner that maintains the integrity of the alternate waistband 13. According to preferred embodiments, the releasable fastening component and maternity band 12 preferably are configured to connect to the garment bottom 11 in a manner that allows the maternity band 12 to be removed so that it may be selectively reinstalled, as desired.

The convertible maternity garment 10 is configured as described and illustrated, having a first condition that provides a first garment configured and arranged to be worn by a woman during her maternity term. The invention also provides a second garment 10' which is configured as a non-maternity garment and which preferably may be constructed from a portion of the first garment 10 to provide a garment having a configuration for non-maternity use. The non-maternity garment 10' is configured attached to at least a portion of the first garment and, according to preferred embodiments, comprises the maternity garment 10. The maternity garment 10 preferably includes at least a portion that is detachable therefrom, so that the user may form a second garment. According to preferred embodiments, the garment 10 of the invention includes a first band comprising the maternity band 12 and an alternate waistband 13. The garment 10 is constructed and configured so that the maternity band 12 functions as a waistband for a maternity garment, and the waistband 13 functions as waistband for the non-maternity configured garment. According to a preferred embodiment, the maternity band 12 is arranged to be functional when the garment 10 is used in the first maternity configuration (FIGS. 1-5 and 11), and the alternate waistband 13 is functional when the garment is used in a non-maternity or second configuration (FIGS. 6-10). The alternate waistband 13 preferably is configured to resemble a waistband of a conventional garment and also to remain as part of the maternity garment when the garment 10 is used in the maternity configuration, but is constructed so that it may be present without the need for the alternate waistband 13 to cinch the waist. Rather, the maternity band 12 may be used to support the convertible maternity garment 10 on the body of the wearer. The alternate waistband 13 may be adjusted with the use of an adjustable fastening component 17. The adjustable fastening component 17 may be utilized to adjust the tension of the garment 10 at the location where the button 15 and button hole 16 are located. The maternity band 12 therefore may be used according to the preferred embodiment when the garment 10 is configured as a maternity garment. Accordingly, the alternate waistband 13 may be provided but may be disabled as a functional waistband when the maternity band 12 is in use, and may be enabled and used to function as the garment waistband when the maternity band 12 is detached.

While the invention has been described with reference to specific embodiments, the description is illustrative and is not to be construed as limiting the scope of the invention. Various modifications and changes may occur to those skilled in the art without departing from the spirit and scope of the invention described herein and as defined by the appended claims. For example, though the garment 10 may look as illustrated as a skirt, the garment may be configured as a pair of pants, shorts, or other items of apparel according to the invention.

What is claimed is:

1. A convertible maternity garment comprising a first garment configured and arranged as a maternity garment to be worn by a woman during her maternity term; said garment being convertible from a maternity garment to a non-maternity garment, wherein said non-maternity garment is constructed from a portion of said maternity garment to provide a garment having a configuration for non-maternity use;

wherein said garment includes at least a portion that is detachable therefrom such that when said portion is detached from said garment the non-maternity garment is formed;

the garment having first means for holding the convertible maternity garment on the body of a wearer when the convertible maternity garment is configured as a maternity garment, and second means for holding the convertible maternity garment on the body of a wearer when the convertible maternity garment is configured as a non-maternity garment;

wherein said first means for holding the convertible maternity garment on the body of a wearer comprises a maternity band that is a stretchable member, wherein said second means for holding the convertible maternity garment on the body of a wearer comprises an alternate waistband; and wherein said maternity band is expandable to a greater extent than said alternate waistband; and wherein said alternate waistband has an inside layer that faces a wearer, a first end with a button and a second end with a button hole; and wherein the first end and the second end of the alternate waistband are selectively engageable with each other; and wherein the garment includes a configurable member that provides alternate engaging for the alternate waistband when the maternity band is present and when said garment is configured as a maternity garment, wherein said configurable member comprises an elastic member and has a first end that is free and a second end that is held on the inside layer of the alternate waistband at a location that is spaced apart from said button hole of said alternate waistband second end; and wherein when said configurable member is stretchable from the location on said alternate waistband second end at which said configurable member second end is held, said configurable member first end is selectively engageable with said first end of said alternate waistband to alternately engage the alternate waistband first end and second end together.

2. The garment of claim 1, wherein the configurable member is configured to allow the alternate waistband to remain engageable when the garment is configured in a second configuration for use as a non-maternity garment.

3. The garment of claim 1, wherein said maternity band is attached to said garment bottom with stitching.

4. The garment of claim 1, wherein said maternity band is removably attached to the bottom portion with a releasable fastening component.

5. A convertible maternity garment comprising: a maternity garment being selectively configurable as a non-maternity garment, having a first configuration comprising a maternity garment to be worn by a woman during her maternity term and being convertible to a second configuration for non-maternity use, the garment including a removable portion comprising a maternity band and having an alternate waistband arranged at a location on the garment so that both said maternity band and said alternate waistband are functional waistbands that are present on the garment simultaneously, wherein said maternity band and said alternate waistband are selectively functional based on the configuration of said garment; and wherein said alternate waistband has an inside layer that faces a wearer, a first end with a button and a second end with a button hole; and wherein the first end and the second end of the alternate waistband are selectively engageable with each other; and wherein the garment includes a configurable member that provides alternate engaging for the alternate waistband when the maternity band is present and when said garment is configured as a maternity garment, wherein said configurable member comprises an elastic member and has a first end that is free and a second end that is held on the inside layer of the alternate waistband at a location that is spaced apart from said button hole of said alternate waistband second end; and wherein when said configurable member is stretchable from the location on said alternate waistband second end at which said configurable member second end is held, said configurable member first end is selectively engageable with said first end of said alternate waistband to alternately engage the alternate waistband first end and second end together.

6. The convertible maternity garment of claim 5, wherein a detachable securing means is provided for securing said maternity band to said garment and for facilitating the selective detachment of the maternity band from said garment.

7. A method for converting a garment designed for use as a maternity garment and a non-maternity garment from a maternity garment to a non-maternity garment, including:

providing a garment configured and arranged as a maternity garment to be worn by a woman during her maternity term, said garment being convertible from a maternity garment to a non-maternity garment, wherein said non-maternity garment is constructed from a portion of the maternity garment, and wherein the garment comprises a maternity band and an alternate waistband configured and arranged so that both said maternity band and said alternate waistband are functional bands that are present on the garment simultaneously, wherein said first waistband and said alternate waistband are selectively functional based on the configuration of said garment;

converting said garment from a maternity garment to a non-maternity garment by removing a removable portion of said garment, wherein converting comprises detaching from said garment said maternity band to provide a non-maternity garment having a configuration for use as a non-maternity garment; and wherein said alternate waistband has an inside layer that faces a wearer, a first end with a button and a second end with a button hole; and wherein the first end and the second end of the alternate waistband are selectively engageable with each other; and wherein the garment includes a configurable member that provides alternate engaging for the alternate waistband when the maternity band is present and when said garment is configured as a maternity garment, wherein said configurable member comprises an elastic member and has a first end that is free and a second end that is held on the inside layer of the alternate waistband at a location that is spaced apart from said button hole of said alternate waistband second end; and wherein when said configurable member is stretchable from the location on said alternate waistband second end at which said configurable member second end is held, said configurable member first end is selectively engageable with said first end of said alternate waistband to alternately engage the alternate waistband first end and second end together.

8. The convertible maternity garment of claim 1, wherein the configurable member is adjustable over a range of lengths to accommodate a range of waist lengths, the configurable member providing an engaged range of positions defining a first set of waist lengths, said configurable member having a disengaged position to provide an alternate waist length, wherein said alternate waist length corresponds with a waist length of said detachable portion of the maternity garment.

9. The convertible maternity garment of claim 8, wherein the configurable member has a fastening element provided on the second end.

10. The convertible maternity garment of claim 9, wherein said fastening element comprises a button provided at the location spaced apart from said button hole of said alternate waistband second end, and wherein said configurable member includes a plurality of alternate button holes comprising positioning options for engagement with said button.

11. The convertible maternity garment of claim 4, wherein the garment has a front and includes a fly opening provided in the front of the garment and an expansion zone provided near the fly opening, wherein said releasable fastening component is configured to provide an expansion zone near said fly opening to define said expansion zone.

12. The convertible maternity garment of claim 3, wherein the garment has a front and includes a fly opening provided in the front of the garment and an expansion zone provided near the fly opening, wherein said stitching that attaches said maternity band to said garment bottom terminates to provide a portion of said maternity band that is unattached at a location near said fly opening to define said expansion zone; and wherein said maternity band is attached to the inside layer of said alternate waistband, and wherein said alternate waistband is provided with an extra seam allowance creating a height on the inside layer of the alternate waistband that is greater than a height on an outside layer of the alternate waistband.

13. The garment of claim 1, wherein said alternate waistband has an upper edge, wherein said maternity band extends below said alternate waistband upper edge, said alternate waistband having an attachment zone and a free zone, wherein said maternity band is attached along said attachment zone of said alternate waistband, and wherein said maternity band is free from attachment at said alternate waistband free zone.

14. The garment of claim 13, wherein said garment has a front, and wherein said free zone is provided in a location at the front of said garment.

15. The garment of claim 1, wherein said alternate waistband has an outside layer, and wherein said maternity band is attached to the inside layer of the alternate waistband, wherein said alternate waistband is provided with an extra seam allowance on the inside layer creating a height on the inside layer that is greater than a height on the outside layer of the alternate waistband.

16. The garment of claim 15, wherein said maternity band is removably attached to the extra seam allowance of said inside layer.

17. The garment of claim 16, wherein the maternity band includes an edge portion that defines a lower end of said maternity band, and wherein said edge portion is proximate to a detachment zone formed along said maternity band.

18. The garment of claim 5, wherein said alternate waistband has an outside layer, and wherein said maternity band is attached to the inside layer of said alternate waistband, wherein said alternate waistband is provided with an extra seam allowance creating a height of said inside layer that is greater than a height of the outside layer.

19. The garment of claim 18, wherein said maternity band is removably attached to the extra seams allowance of said inside layer.

20. The method of claim 7, wherein providing said garment includes providing the maternity band with an attachment area defined by two terminal ends of the attachment area that provides an expansion zone between the ends wherein said expansion zone consists of an area where there is no attachment of the maternity band with the alternate band in that said zone, and wherein converting includes detaching said maternity band from the attachment area.

* * * * *